United States Patent [19]

Hebda

[11] 4,010,933

[45] Mar. 8, 1977

[54] GARAGE WITH IMPROVEMENT TO PROTECT AGAINST DAMAGE TO PARKED CARS

[76] Inventor: Thomas Hebda, 235 Vance, Lombard, Ill. 60148

[22] Filed: Jan. 12, 1976

[21] Appl. No.: 648,276

[52] U.S. Cl. ..... 256/23; 160/330

[51] Int. Cl.[2] ..... A47H 23/00

[58] Field of Search ..... 49/9, 34, 460; 116/28; 256/23, 1; 52/63, 240, 174, 238; 135/8; 15/98 B; 134/45, 123; 160/252–260; 119/21, 27, 11; 16/87 Z, 87 R

[56] References Cited

UNITED STATES PATENTS

| | | | |
|---|---|---|---|
| 591,792 | 10/1897 | Stitzer | 119/11 |
| 1,126,243 | 1/1915 | McQuown | 49/460 |
| 3,099,313 | 7/1963 | Peck et al. | 52/240 |
| 3,610,669 | 10/1971 | Morrisey, Sr. | 293/62 |
| 3,704,037 | 11/1972 | Glassberg | 293/62 |

*Primary Examiner*—Werner H. Schroeder
*Assistant Examiner*—Doris L. Troutman
*Attorney, Agent, or Firm*—Carl C. Batz

[57] ABSTRACT

A garage in which cars are parked side by side in parallel spaced relation and there is suspended between them a sheet of resilient material, which, when a door of one of the cars is opened between them, will allow the door to open as necessary but will prevent damage to the other car.

6 Claims, 2 Drawing Figures

GARAGE WITH IMPROVEMENT TO PROTECT AGAINST DAMAGE TO PARKED CARS

Figure 1:
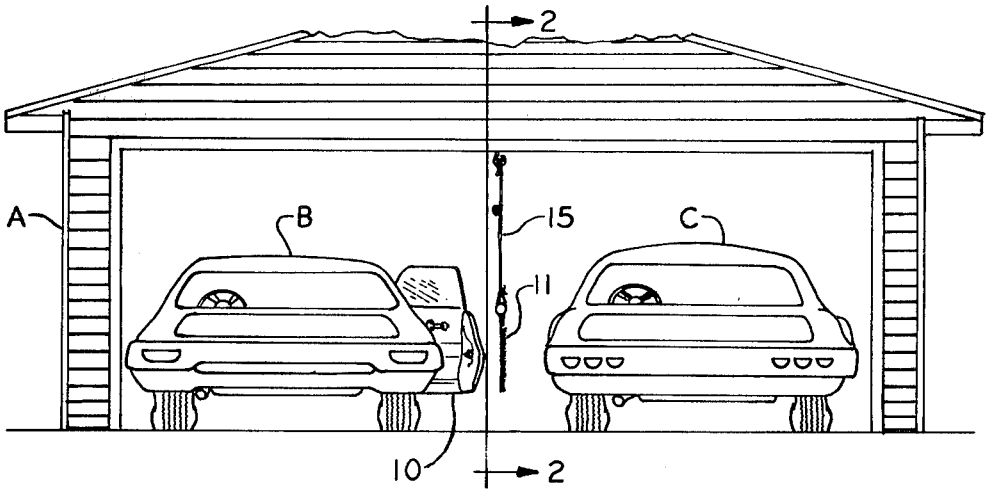

This invention relates to a garage which provides parking for more than one car and which contains as an improvement a device in the form of a resilient sheet for preventing the door of one car from striking the other car when the door is opened.

BACKGROUND

It is a common occurance that when two cars are parked in parallel arrangement in a garage, and someone opens a car door between the cars, the edge of the door will strike the other car unless the person opening the car door takes special precaution to hold the car door.

The art is replete with devices of various kinds to be mounted on the car which is to be protected so as to ward off contacts with the car doors of other vehicles. These devices include structures which are secured to the car and extend along the side of the car. In some cases, rolls of protective material are carried within a car and may be pulled into position to cover the side of the car. Also there have been pads which are to be hung on a car door handle and are intended to protect against damage through contact with doors of other vehicles. These devices usually can not be left on the car while the car is being operated and there is inconvenience in removing the devices when the car is to be used and installing them when the car is parked.

Therefore, I have sought an improvement which could be a more permanent installation in a garage, which would be simple of construction, and which would provide adequate protection when cars are parked side by side in the garage. I have discovered such an improvement, and one embodiment of this invention is illustrated in the accompanying drawings and explained in the following description.

DESCRIPTION

Figure 2:
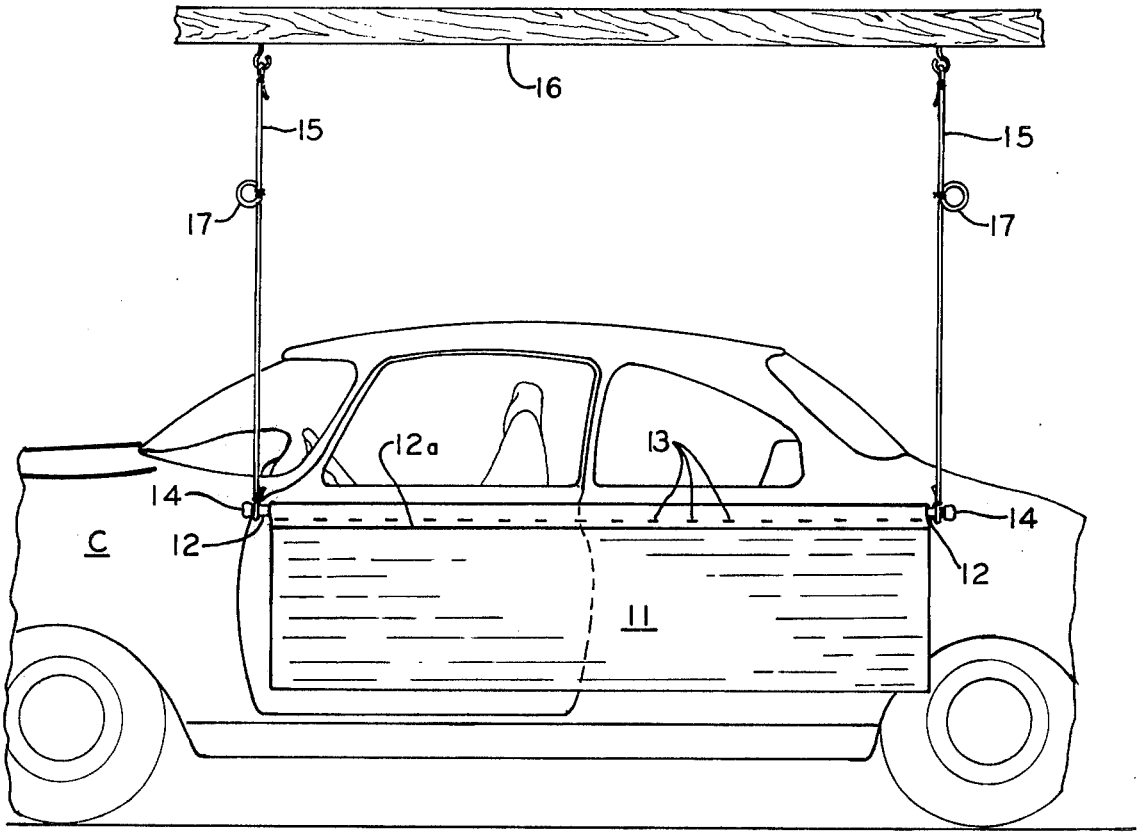

In the drawings,

FIG. 1 is a broken elevational view of the front of a garage showing cars parked within the garage side by side with the improved protective device between them; and FIG. 2 is an enlarged longitudinal view in elevation taken as seen from line 2—2 of FIG. 1.

As illustrated, the garage A is designed to accommodate the parking of cars B and C in side-by-side parallel spaced relation. The door 10 of car B is of a width such that when the door is opened widely to allow a person to enter the car comfortably its edge would be likely to strike the car C if it were not for the device which is suspended in the space between the cars.

Referring now to FIG. 2, my improvement includes a sheet 11 of resilient material, This sheet may be made of materials commonly used for floor coverings such as woven or unwoven fabric or padding materials including a sponge rubber sheet. Suitably, I may use carpeting material designed either for indoor or outdoor use. The thickness of the sheet need not be great but should be sufficient to provide the necessary resiliency to prevent nicking of the other car when and if struck the type of blow which is usual when the door of an adjacent car is flung open against it.

The sheet 11 is generally rectangular in shape and has its upper edge portion passed around a rail 12 and the edge 12a fastened to the main body of the sheet by staples 13. This forms a hem with rail 12 contained therein. The rail 12 may be any support rod which may be solid or in the form of a tube such as the tubing commonly used for electrical conduit. Desirably, the rod should have rigidity such that it will not bow to an objectionable degree when the rail bears the weight of the sheet and is supported in horizontal position at its ends. The rail may be supported so that it extends at about the level of the car door window and with the sheet extending downwardly in the space between the cars to about the bottom of the door. It is important only that the bottom of the sheet extend below the level at which the space between the cars is at a minimum. Some cars bulge outwardly at about the level of the center of the door and the sheet should extend between the cars at this level.

As is shown in FIG. 2, the ends of rail 12 protrude beyond the sheet, and each end of the rail is provided with a cap 14 which protects the cars against damage through possible contact with the ends of the rail.

The device is suspended from the ceiling structure 16 of the garage by means of a pair of flexible cords 15. One cord 15 has its lower end tied to one end of rail 12 just inward of cap 14 and its other end tied to a screw fastener in the ceiling structure 16. Similarly the other cord 15 has its lower end tied to the other end of rail 12 and has its upper end tied to a screw fastener in the ceiling structure. Cords 15 are each provided with loop 17 at a height above the normal position of the sheet to provide a way to hold the sheet at a higher level when desired. The loops 17 are large enough to receive the end of the rail and when desired the rail ends may be inserted into the loops, thus to hold the sheet up out of the way, for example, when the car is being washed.

After installation, the sheet 11 hangs suspended from the ceiling structure of the garage in the space between the parked cars. Desirably, the sheet should extend in a vertical plane about midway between the cars.

When someone opens a door as is shown to be happening in FIG. 1, the door, when it strikes the sheet, will simply push the sheet over. If the door is opened widely it will push the sheet against the other car but no damage will result because of the resiliency of the sheet material.

It is an added advantage of my improvement that the person opening the car door need not be afraid of damaging the other car and may feel free to open the door to a position which will allow comfortable entrance into the car. Thus, this avoids having to hold the door to keep it from opening too far at the same time a person is entering the car.

It may, at first, appear that the space available for entering one of the two spaced cars is reduced by the presence of the sheet betwen them. However, this is not the case because of the suspension of the sheet from above so that the sheet is yieldable toward either side.

While I have described my invention with respect to a two car garage with two cars parked therein it will be apparent that the invention is applicable to any garage in which a plurality of cars may be parked. This is a further advantage that the sheet suspended from above gives a good appearance and marks out stalls for the cars, and the sheets thus serve as guides for motorists in parking their cars, but at the same time present no hazards which may damage the cars.

While I have illustrated and described in detail only one embodiment of the invention it will be apparent to one skilled in the art that many embodiments may be constructed and many changes made all within the spirit of the invention and the scope of the appended claims.

What is claimed is:

1. In a garage having a ceiling structure and providing parking space for two or more cars in which two cars are parked in spaced parallel relationship at least one of said cars having a door which opens into the space between cars, the improvement comprising a flexible resilient sheet, and means for suspending said sheet from said ceiling structure in a vertical plane between said cars and spaced from each of said cars, whereby when said door is opened said sheet prevents the door from striking the other of said cars.

2. A garage and improvement therein as set forth in claim 1 wherein said means includes a rigid rail attached to the upper edge portion of said sheet and a pair of cords having their one end attached to said rail and their other end attached to the ceiling structure of the garage.

3. A garage and improvement therein as set forth in claim 2 in which each of said cords has a loop therein capable of receiving an end of said rail and being located intermediate the ends of the cord whereby said sheet may be suspended at a greater height by inserting each end of said rail in one of said loops.

4. A garage and improvement therein as set forth in claim 2 in which the upper edge of said sheet is passed around said rail and attached to the main body of the sheet.

5. A garage and improvement therein as set forth in claim 2 in which the ends of said rail protrude beyond the end edges of said sheet and in which a cap of resilient material is positioned over each end of said rail.

6. A garage and improvement therein as set forth in claim 1 in which said sheet is a fabric.

* * * * *